US008546679B2

(12) United States Patent
Oba et al.

(10) Patent No.: US 8,546,679 B2
(45) Date of Patent: Oct. 1, 2013

(54) KEYBOARD MUSICAL INSTRUMENT, PROGRAM, PERFORMANCE DATA CONVERSION PROGRAM AND DEVICE

(75) Inventors: Yasuhiko Oba, Hamamatsu (JP); Akinori Kanehara, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/439,291

(22) Filed: Apr. 4, 2012

(65) Prior Publication Data

US 2012/0255425 A1 Oct. 11, 2012

(30) Foreign Application Priority Data

Apr. 5, 2011 (JP) ..... 2011-083557

(51) Int. Cl.
*G10H 1/32* (2006.01)
*G10H 3/00* (2006.01)

(52) U.S. Cl.
USPC ..... 84/746

(58) Field of Classification Search
USPC ..... 84/746, 662, 626
See application file for complete search history.

(56) References Cited

U.S. PATENT DOCUMENTS

| | | | | |
|---|---|---|---|---|
| 5,131,306 | A | 7/1992 | Yamamoto | |
| 7,453,037 | B2 * | 11/2008 | Ishii et al. | 84/600 |
| 7,943,843 | B2 * | 5/2011 | Komatsu | 84/615 |
| 7,977,564 | B2 * | 7/2011 | Takigawa | 84/670 |
| 8,106,287 | B2 * | 1/2012 | Hasebe | 84/662 |
| 8,203,066 | B2 * | 6/2012 | Maruyama | 84/626 |
| 8,242,347 | B2 * | 8/2012 | Ikeya et al. | 84/746 |
| 2009/0205476 | A1 | 8/2009 | Komatsu | |
| 2009/0235803 | A1 * | 9/2009 | Iwamoto et al. | 84/229 |
| 2009/0314156 | A1 | 12/2009 | Komatsu | |
| 2010/0018378 | A1 | 1/2010 | Takigawa | |
| 2010/0089225 | A1 * | 4/2010 | Maruyama | 84/626 |
| 2010/0288102 | A1 | 11/2010 | Fujiwara et al. | |
| 2011/0061518 | A1 * | 3/2011 | Iwamoto et al. | 84/746 |

FOREIGN PATENT DOCUMENTS

| | | | |
|---|---|---|---|
| JP | 4-350898 | A | 12/1992 |
| JP | 2010-266606 | A | 11/2010 |

OTHER PUBLICATIONS

Extended European Search Report dated Oct. 2, 2012 (Six (6) pages).

* cited by examiner

*Primary Examiner* — Jeffrey Donels
(74) *Attorney, Agent, or Firm* — Crowell & Moring LLP

(57) ABSTRACT

A keyboard musical instrument, including: keys; a pedal; an input portion configured to input performance data including tone generation control data that specifies generation and halt of a musical tone and pedal control data that specifies a depression depth of the pedal; a drive portion configured to drive the pedal; and a controller configured to control the drive portion on the basis of the pedal control data in the performance data inputted by the input portion, wherein the controller is configured to control the drive portion such that, where the depression depth of the pedal exceeds a first depth by controlling the drive portion, the pedal is located at a third depth that is shallower than a second depth after the pedal has reached the second depth that is deeper than the first depth.

9 Claims, 8 Drawing Sheets

KEYBOARD MUSICAL INSTRUMENT, PROGRAM, PERFORMANCE DATA CONVERSION PROGRAM AND DEVICE

CROSS REFERENCE TO RELATED APPLICATION

The present application claims priority from Japanese Patent Application No. 2011-083557, which was filed on Apr. 5, 2011, the disclosure of which is herein incorporated by reference in its entirety.

BACKGROUND OF THE INVENTION

1. Field of the Invention

The present invention relates to a technique for driving a pedal on the basis of pedal control data in performance data.

2. Discussion of Related Art

There is conventionally known a keyboard musical instrument configured to automatically execute a musical tone control involving a pedal motion control, on the basis of performance data. For instance, in a musical instrument disclosed in each of the following Patent Literatures 1, 2, keys are driven on the basis of tone generation control data in the performance data so as to strike strings for generating musical tones, and a pedal is driven on the basis of pedal control data in the performance data, whereby it is intended that a recorded performance state is exactly or faithfully reproduced.

As the performance data on the basis of which the musical tone control is executed, there is used data in which a performance operation that a performer actually has performed is recorded. The pedal is driven generally using an electromagnetic actuator.

Patent Literature 1: JP-A-4-350898

Patent Literature 2: JP-A-2010-266606

SUMMARY OF THE INVENTION

Where the pedal is electromagnetically driven, however, a large amount of electric power is consumed depending upon a form or configuration of the recorded performance.

For instance, a region of a depression depth of a damper pedal (i.e., a loud pedal) is generally classified into a mute region, a half pedal region, and a fully released region. Even within the same fully released region, the power consumption is larger when the pedal is controlled so as to be kept located at a position in the fully released region which is near to an end position than when the pedal is controlled so as to be kept located at other position which is not near to the end position, in the same fully released region.

Further, the behavior of the pedal is influenced by habits of the performer who plays in recording the performance data. For instance, there is a case in which the pedal position is not stabilized at the end position and moves in a depth direction after the pedal has been depressed near to the end position. In this case, a motion is reproduced in which the pedal repeatedly fluctuates in the depth direction in the vicinity of the end position, following the data.

Moreover, a depression force by which the pedal is depressed varies from performer to performer. When a long tune is played, for instance, the performer may yield to the weight of the pedal when the performer continues to depress the pedal or the performer cannot keep the pedal located at a constant position due to fatigue of the foot. In such instances, the recorded performance data represents data in which the pedal swingingly moves in the fully released region.

Accordingly, if the performance data that has been recorded following the actual performance is to be exactly or faithfully reproduced as it is, a minute motion which is not necessarily required to be reproduced, namely, which is meaningless in performance, is also reproduced. For instance, as long as the pedal is located within the fully released region, there is little difference in action irrespective of at which position the pedal is located. Nevertheless, the pedal wastefully moves. Such reproduction undesirably causes the electric power to be wastefully consumed. Thus, there is a room for improvement.

The present invention is made to solve the problems experienced in the conventional technique described above. It is therefore an object of the invention to achieve power saving without giving, to reproduction tones, an influence that arises from a motion of the pedal.

The above-indicated object may be attained according to a first aspect of the invention, which provides a keyboard musical instrument, comprising:

keys (1);

a pedal (110);

an input portion (120) configured to input performance data including tone generation control data that specifies generation and halt of a musical tone and pedal control data that specifies a depression depth of the pedal;

a drive portion (23) configured to drive the pedal; and a controller (140) configured to control the drive portion on the basis of the pedal control data in the performance data inputted by the input portion, wherein the controller is configured to control the drive portion such that, where the depression depth of the pedal exceeds a first depth by controlling the drive portion, the pedal is located at a third depth that is shallower than a second depth after the pedal has reached the second depth that is deeper than the first depth.

The above-indicated object may be attained according to a second aspect of the invention, which provides a storage medium in which is stored a program which permits a computer to execute a control of a keyboard musical instrument including a drive portion configured to drive a pedal, wherein the program comprises:

an input step of inputting performance data including tone generation control data that specifies generation and halt of a musical tone and pedal control data that specifies a depression depth of the pedal; and a control step of controlling the drive portion on the basis of the pedal control data in the performance data inputted in the input step, wherein the control step controls the drive portion such that, where the depression depth of the pedal exceeds a first depth by controlling the drive portion, the pedal is located at a third depth that is shallower than a second depth after the pedal has reached the second depth that is deeper than the first depth.

The above-indicated object may be attained according to a third aspect of the invention, which provides a storage medium in which is stored performance data conversion program executed by a computer, wherein the performance data conversion program comprises:

an input step of inputting performance data including tone generation control data that specifies generation and halt of a musical tone and pedal control data that specifies a depression depth of a pedal;

a conversion step of converting the pedal control data in the performance data inputted in the input step; and an update step of updating the performance data by replacing the pedal control data in the performance data inputted in the input step with the pedal control data that has been converted in the conversion step, wherein the conversion step converts the pedal control data such that, where the depression depth of the pedal indicated by the pedal control data exceeds a first depth, the pedal is located at a third depth that is shallower than a second depth after the pedal has reached the second depth that is deeper than the first depth.

The above-indicated object may be attained according to a fourth aspect of the invention, which provides a performance data conversion device equipped with a computer in which the performance data conversion program described above is executably incorporated.

The reference signs in the brackets attached to respective constituent elements in the above description correspond to reference signs used in the following embodiment to identify the respective constituent elements. The reference sign attached to each constituent element indicates a correspondence between each element and its one example, and each element is not limited to the one example.

BRIEF DESCRIPTION OF THE DRAWINGS

The above and other objects, features, advantages and technical and industrial significance of the present invention will be better understood by reading the following detailed description of an embodiment of the invention, when considered in connection with the accompanying drawings, in which.

DETAILED DESCRIPTION OF THE EMBODIMENT

Hereinafter, there will be explained one embodiment of the present invention with reference to the drawings.

Figure 1:
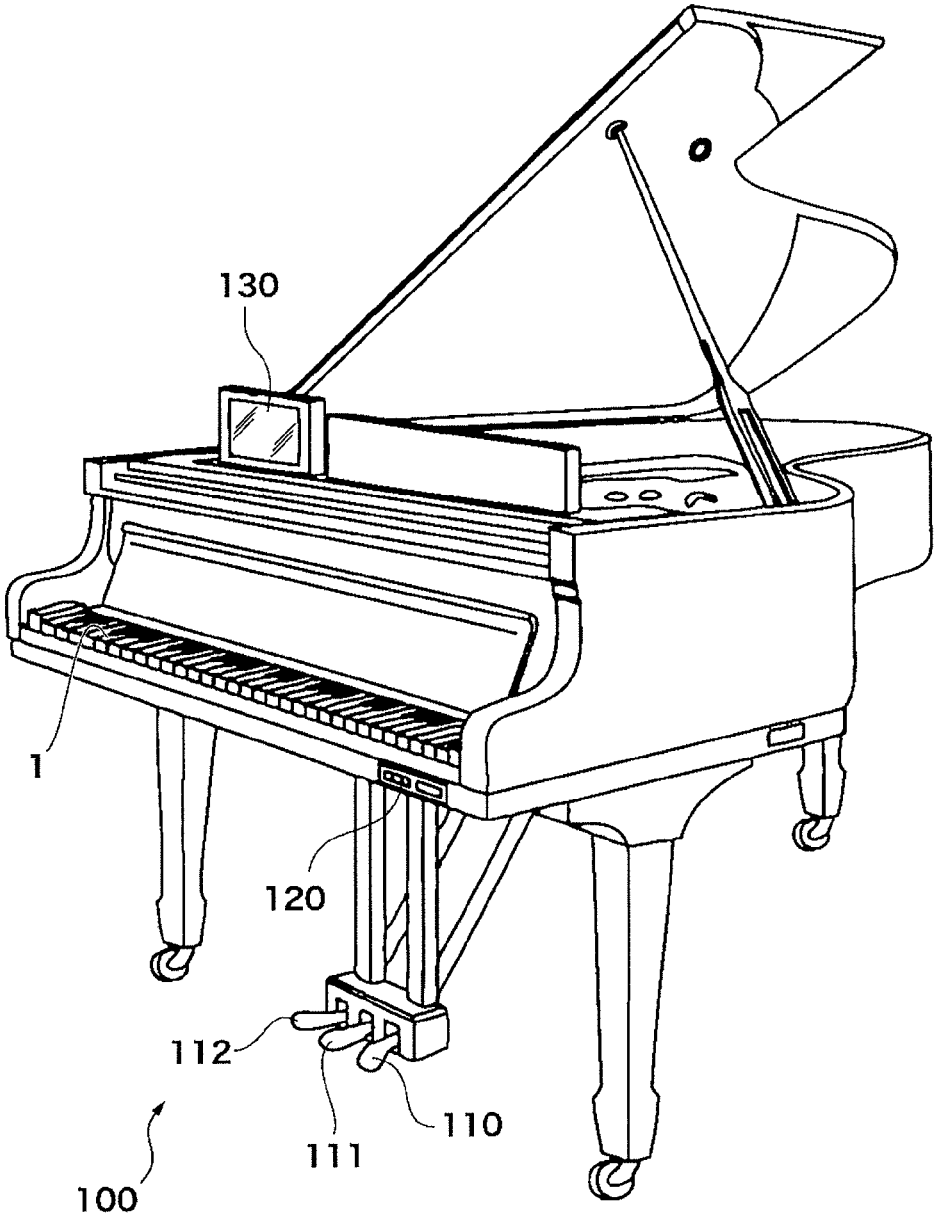
FIG. 1 is an external view of a keyboard musical instrument according to one embodiment of the present invention.

FIG. 1 is an external view showing an automatic player piano 100 as a keyboard musical instrument according to one embodiment of the present invention. The automatic player piano 100 includes a plurality of keys 1, a damper pedal 110, a sostenuto pedal 111, an a soft pedal 112. The automatic player piano 100 further includes a disk drive 120 configured to read out performance data from a recording medium such as DVD (Digital Versatile Disk) and CD (Compact Disk) in which the performance data in MIDI (Musical Instrument Digital Interface) format is recorded. Further, there is disposed, beside a music stand, an operation panel 130 configured to display various menu screens for operating the automatic player piano 100 and to accept directions from a performer of the automatic player piano 100.

Figure 2:
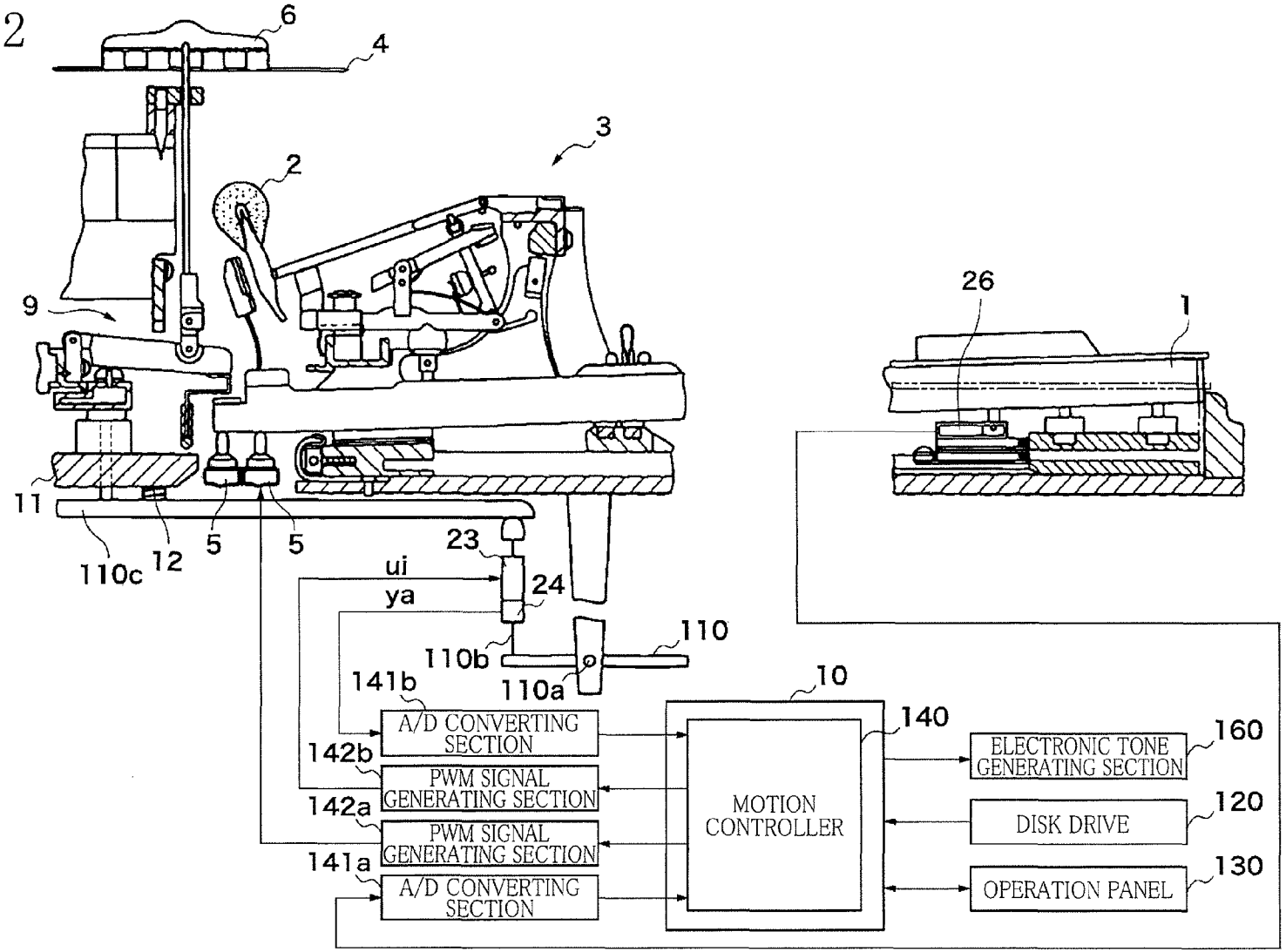
FIG. 2 is a view showing a mechanical structure and functions and an electric structure of a principal part of an automatic player piano as the keyboard musical instrument.

FIG. 2 is a view showing a mechanical structure and functions and an electric structure of a principal part of the automatic player piano 100. The automatic player piano 100 includes hammer action mechanisms 3 provided so as to correspond to the respective keys 1, key solenoids 5 for driving the associated keys 1, key sensors 26 provided for the respective keys 1, a damper pedal 110, a damper mechanism 9 for transmitting a motion of the damper pedal 110 to dampers 6, a pedal solenoid 23 for driving the damper pedal 110, and a pedal position sensor 24 for detecting a position of the damper pedal 110.

In FIG. 2, there are illustrated only a portion of the key 1 near to the corresponding hammer action mechanism 3 and a portion of the key 1 depressed by the performer, and illustration of other portion of the key 1 is omitted. In FIG. 2, the right side is a performer's side while the left side is a rear side as seen from the performer. Eighty eight keys 1 are arranged in a direction perpendicular to the sheet plane of FIG. 2, and eighty eight hammer action mechanisms 3 and eighty eight key sensors 26 are arranged so as to correspond to the respective keys 1.

The keys 1 are swingably supported and are depressed by the performer. The hammer action mechanisms 3 each having a hammer 2 are for striking associated strings 4 which are stretched so as to correspond to the respective keys 1. When the performer depresses the key 1, the hammer 2 strikes the string 4 in response to the movement of the key 1. Each of key solenoids 5 is for driving the associated key 1. When a signal to drive the key solenoid 5 is supplied, a plunger of the key solenoid 5 displaces. When the key is moved upward by the displacement of the plunger, the hammer 2 strikes the string 4 in response to the movement of the key 1. Each of the key sensors 26 is disposed below a front-side end portion (on the right side in FIG. 2) of the associated key1 and is configured to detect a motion state of the key 1 such as the position and the velocity, so as to output a signal indicative of the detected motion state.

The damper pedal 110 is supported so as to rotate about a rotation shaft 110*a*. Hereinafter, one side of the damper pedal 110 located on a right side of the rotation shaft 110*a* in FIG. 2 is referred to as a front end side while another side of the damper pedal 110 located on a left side of the rotation shaft 110*a* in FIG. 2 is referred to as a rear end side. As shown in FIG. 2, a pedal lever spring 12 is attached between a pedal lever 110*c* and a key bed 11. The front end side of the damper pedal 110 is pushed upward by the pedal lever spring 12 and the damper mechanism 9.

On the rear end side of the damper pedal 110, a pedal rod 110*b* is connected, and the pedal solenoid 23 and the pedal position sensor 24 are provided on the pedal rod 110*b*. The pedal position sensor 24 is configured to detect a position, in the vertical direction, of an operational portion of the damper pedal 110 operated by the performer, on the basis of a position, in the vertical direction, of the pedal rod 110*b*, and to output a signal (ya) indicative of the detected position. The pedal position sensor 24 outputs a signal representing "0" as a value indicative of the position in the vertical direction when the damper pedal 110 is located at a rest position. The value to be outputted from the pedal position sensor 24 becomes larger as the position of the operational portion of the damper pedal 110 becomes lower as a result of depression by the performer.

The damper mechanism 9 is for transmitting the motion of the damper pedal 110 to the dampers 6. When the performer depresses the damper pedal 110 against a force of the pedal lever spring 12 and the damper mechanism 9, the damper pedal 110 rotates about the rotation shaft 110*a*, and the pedal rod 110*b* moves upward. This movement of the pedal rod 110*b* is transmitted to the dampers 6 via the damper mechanism 9, so that the dampers 6 are spaced apart from the associated strings. When the performer releases his/her foot from the damper pedal 110, the damper pedal 110 returns to a prescribed position owing to the force of the pedal lever spring 12 and the damper mechanism 9, so that the dampers 6 press the associated strings 4.

The pedal solenoid 23 is a drive portion configured to drive the dampers 6. When a signal (ui) for driving the pedal solenoid 23 is supplied, a plunger of the pedal solenoid 23 displaces. When the plunger displaces and thereby moves the damper mechanism 9, the dampers 6 are moved in response to the movement of the damper mechanism 9. The automatic player piano 100 further includes a controller 10 including a motion controller 140 attained by software.

Figure 3:
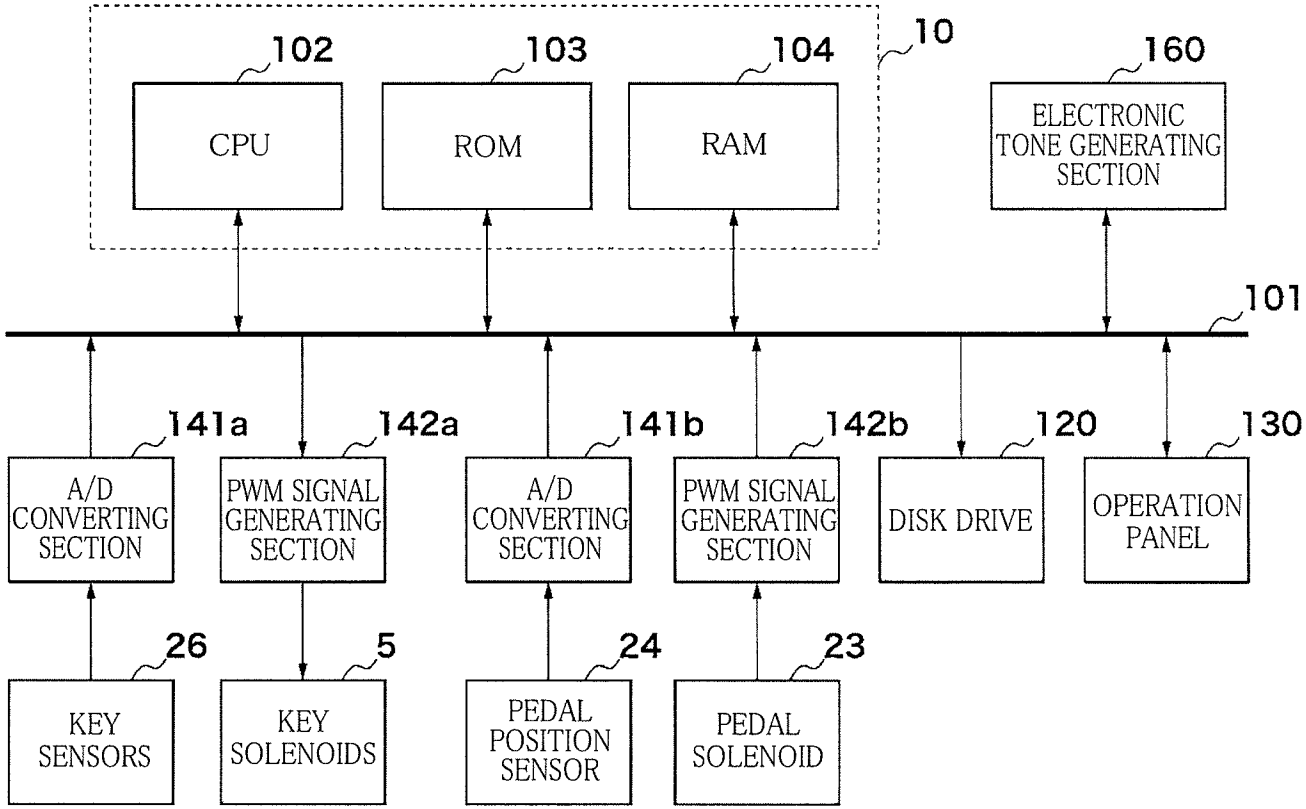
FIG. 3 is a block diagram showing a functional structure of the automatic player piano.

FIG. 3 is a block diagram showing a functional structure of the automatic player piano 100. The automatic player piano 100 includes a CPU 102, a ROM 103, a RAM 104, the disk drive 120, the operation panel 130, and an electronic tone generating section 160 which are connected to a bus 101 and which receive and transmit various data via the bus 101. The electronic tone generating section 160 includes a tone source circuit and speakers. The tone source circuit generates musical tone signals in accordance with signals supplied from the bus 101 and supplies the generated signals to the speakers, whereby musical tones are outputted from the speakers.

The controller 10 includes the CPU 102, the ROM 103, and the RAM 104. The CPU 102 executes a control program stored in the ROM 103 utilizing the RAM 104 as a work area. When the control program stored in the ROM 103 is executed, the key solenoids 5 and the pedal solenoid 23 are driven according to the performance data read out form the disk drive 120, whereby automatic performance is realized.

The motion controller 140 is a functional block attained by execution of the control program by the CPU 102 and is configured to control the movements or motions of the keys 1 and the damper pedal 110. The motion controller 140 outputs a drive signal to a PWM signal generating section 142*a* connected to the key solenoids 5 and to receive a signal from an A/D converting section 141*a* connected to the key sensors 26. Further, the motion controller 140 is configured to output a drive signal to a PWM signal generating section 142*b* connected to the pedal solenoid 23 and to receive a signal from an A/D converting section 141*b* connected to the pedal position sensor 24.

The PWM signal generating section 142*a* converts the drive signal into a signal in a pulse width modulation (PWM) mode and outputs the converted signal (PWM signal) to the key solenoids 5 corresponding to the respective keys 1. Similarly, the PWM signal generating section 142*b* converts the drive signal into a signal in a pulse width modulation (PWM) mode and outputs the converted PWM signal (ui) to the pedal solenoid 23. The key solenoids 5 and the pedal solenoid 23 displace the plungers thereof according to the outputted PWM signals.

The A/D converting section 141*a* converts an analog signal outputted from each key sensor 26 to a digital signal and outputs the converted digital signal to the motion controller 140. The A/D converting section 141*b* converts an analog signal (ya) outputted from the pedal position sensor 24 into a digital signal and outputs the converted digital signal to the motion controller 140.

When the automatic performance is carried out, the motion controller 140 generates trajectory data representing a trajectory in accordance with a lapse of time for specifying at what timing the keys 1 and the damper pedal 110 are moved, on the basis of the performance data in the MIDI format. The motion controller 140 feedback-controls driving of the keys 1 and the damper pedal 110 on the basis of the trajectory data.

Figure 4:
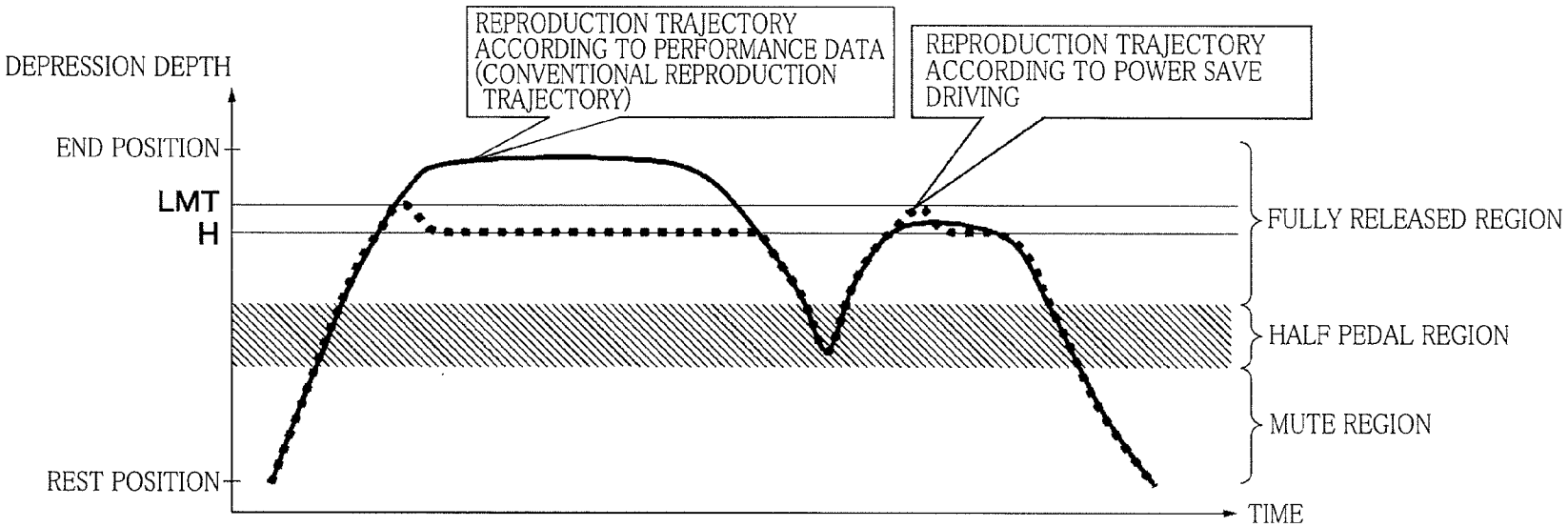
FIG. 4 is a graph showing one example of a reproduction trajectory of a motion of a damper pedal.

There will be next described a control by power save driving of the damper pedal 110 in the present embodiment. FIG. 4 is a graph showing one example a reproduction trajectory of the motion of the damper pedal 110. In the graph of FIG. 4, the horizontal axis represents time while the vertical axis represents depression depth of the damper pedal 110, i.e., a distance from the rest position.

The performance data is formed in advance and available, by recording actual performance by the performer in another keyboard musical instrument, for instance. The performance data contains tone generation control data that specifies generation and halt of a musical tone and pedal control data that specifies the depression depth of the damper pedal 110. The tone generation control data is event data (note-on, note-off, etc.) for the keyboard while the pedal control data is event data for the pedal that specifies the depth of the pedal and timing. It is noted, however, that the depression depth in FIG. 4 is not the position of the damper pedal 110 actually detected, but the depth specified by the pedal control data in the performance data, i.e., target pedal depth POS1 which will be explained.

In a depression stroke of the damper pedal 110 from the rest position to the end position, a region which is a free play region wherein the influence of depression is not transmitted to the dampers 6 and in which the strings 4 are in contact with the dampers 6 is a mute region. In the depression stroke, a region which ranges from a depression depth at which a press contact force of the dampers 6 with respect to the strings 4 starts to decrease to a depression depth immediately before the press contact force of the dampers 6 with respect to the strings 4 becomes zero (non-contact state) is a half pedal region. A region in which the dampers 6 are subsequently spaced apart from the strings 4 (spaced state) is a fully released region. In the fully released region, the dampers 6 are entirely spaced apart or released from the strings 4.

In FIG. 4, both of a limit value LMT (as one example of second depth) and a hold depth H (as one example of a first depth and one example of a third depth) belong to the fully released region. The depression depth corresponding to the limit value LMT is deeper than the hold depth H and is shallower than the end position. In FIG. 4, the solid line indicates a trajectory in an instance in which the performance data is reproduced as it is, namely, in which the pedal is driven according to the performance data. The dotted line indicates a trajectory according to the power save driving.

Following the solid line, the damper pedal 110 is driven near to the end position past the hold depth H and the limit value LMT and is kept located in the vicinity of the end position for a while. Subsequently, the damper pedal 110 once returns toward a shallow depth side shallower than the limit value LMT and the hold depth H. Thereafter, the damper pedal 110 again exceeds the hold depth H, then starts to return before reaching the limit value LMT, and finally returns to the rest position. Where the motion controller 140 executes the control according to the performance data so as to actuate the pedal solenoid 23 for driving the damper pedal 110 in the conventional arrangement, the damper pedal 110 moves as indicated by the solid line.

On the other hand, where the power save driving is applied, the damper pedal 110 moves as indicated by the dotted line. That is, after the depression depth of the damper pedal 110 has exceeded the hold depth H following the same trajectory indicated by the solid line, the damper pedal 110 is driven to the limit value LMT irrespective of the value of the target pedal depth POS1 which is deeper than the hold depth H. However, after the depression depth of the damper pedal 110 has reached the limit value LMT, the damper pedal 110 returns to the hold depth H and is kept located at the position corresponding to the hold depth H until the target pedal depth POS1 becomes shallower than the hold depth H. After the target pedal depth POS1 has become shallower than the hold depth H, the damper pedal 110 moves following the same trajectory indicated by the solid line according to the target pedal depth POS1.

When the depression depth of the damper pedal 110 again exceeds the hold depth H thereafter, the damper pedal 110 is forcibly moved to the depression depth corresponding to the limit value LMT even if the target pedal depth POS1 is shallower than the limit value LMT. Then the damper pedal 110 returns to the hold depth H and is kept located at the position corresponding to the hold depth H until the target pedal depth POS1 becomes shallower than the hold depth H. Subsequently when the target pedal depth POS1 becomes shallower than the hold depth H, the damper pedal 110 moves following the same trajectory indicated by the solid line according to the target pedal depth POS1.

In other words, always when the depression depth of the damper pedal 110 exceeds the hold depth H, the damper pedal 110 reaches the limit value LMT and subsequently returns to the hold depth H. Thereafter, while the damper pedal 110 is being controlled so as to be kept located at the position corresponding to the hold depth H, the control for keeping the damper pedal 110 at the position is continued until the target pedal depth POS1 becomes shallower than the hold depth H, and the damper pedal 110 does not move even if the target pedal depth POS1 becomes deeper than the hold depth H.

To return the damper pedal 110 to the hold depth H after permitting the damper pedal 110 to once reach the limit value LMT when exceeded the hold depth H has a significance of a reduction of power consumption effectively utilizing a characteristic of hysteresis that the motion mechanism of the damper pedal 110 has.

Figure 5:
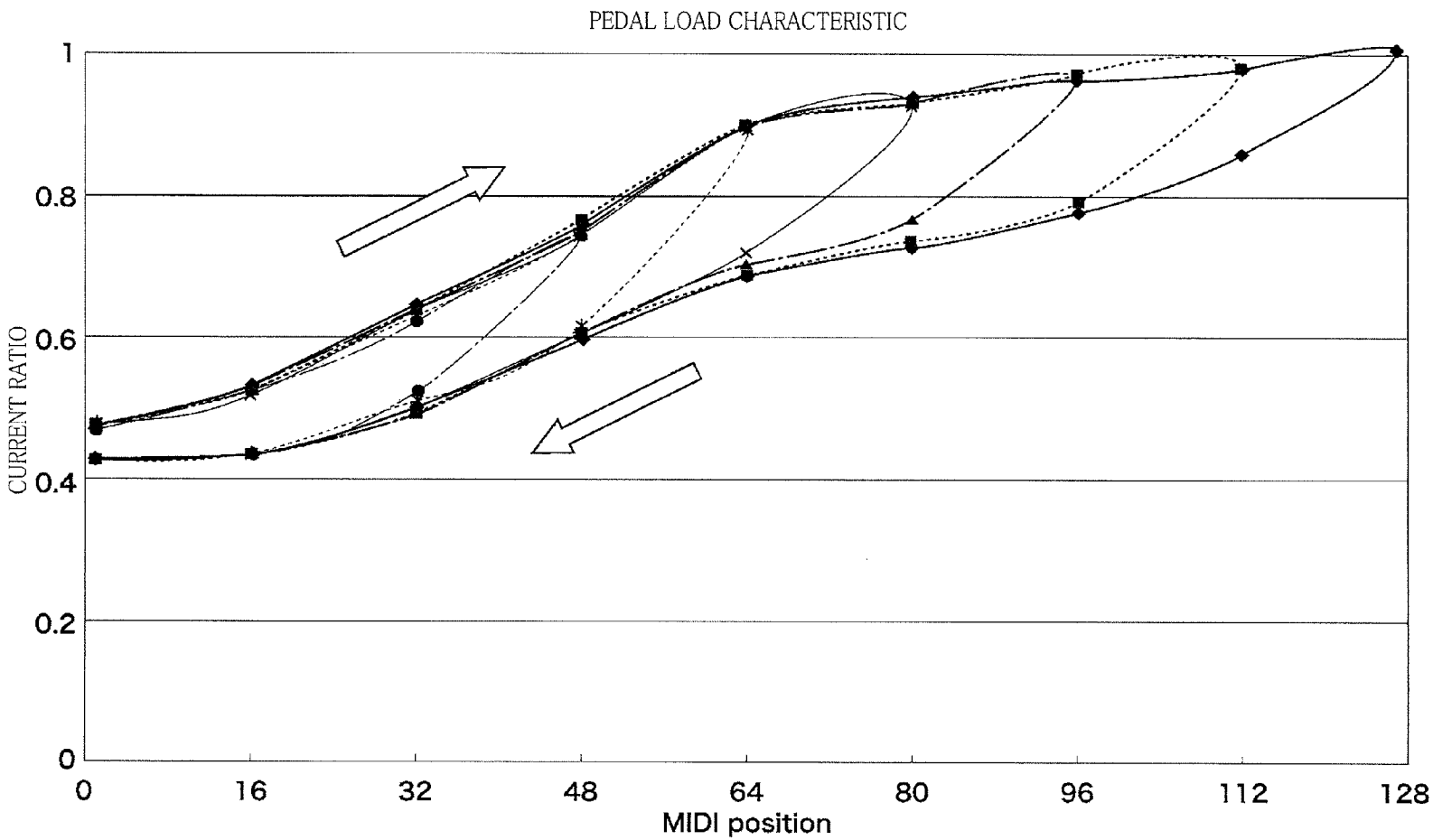
FIG. 5 is a graph showing a pedal load characteristic.

FIG. 5 is a graph showing a pedal load characteristic. FIG. 5 shows an electric current amount when the damper pedal 110 is halted and held at each position of the depression depth corresponding to the MIDI value indicated by the pedal control data of the performance data. That is, the electric current amounts are plotted when the damper pedal 110 is halted at each position in a reciprocating movement of the damper pedal 110. The motion mechanism of the damper pedal 110 has the hysteresis characteristic due to factors such as mechanical friction of various parts and flexure. Therefore, as apparent from FIG. 5, the drive force for stationarily keeping the damper pedal 110 at a certain position is smaller when the damper pedal 110 is driven in the return direction and is halted than when the damper pedal 110 is driven in the depression direction and is halted.

Further, since the spaced state in which the dampers 6 are spaced apart from the strings 4 does not change as long as the damper pedal 110 is located within the fully released region, there is little difference in the characteristic of the musical tones reproduced. Accordingly, as long as the damper pedal 110 is located within the fully released region, it is not needed to drive the damper pedal 110 to the end position by exactly following the pedal control data or it is not needed to exactly reproduce a motion of the damper pedal 110 to minutely swing in the depth direction. In view of no influence on the reproduction tones, it is rather preferable to keep the damper pedal 110 at a constant position for power saving. It is more preferable to keep the damper pedal 110 at a shallower position.

In the present embodiment, therefore, a position which is within the fully released region and which is near to the half pedal region is set as the hold depth H. Further, the damper pedal 110 is controlled such that, after the damper pedal 110 has been once moved to the position corresponding to the limit value LMT, the damper pedal 110 is moved in the return direction and is stably kept at the hold depth H. Hereinafter, these controls are explained in detail with reference to flow charts.

Figure 6:
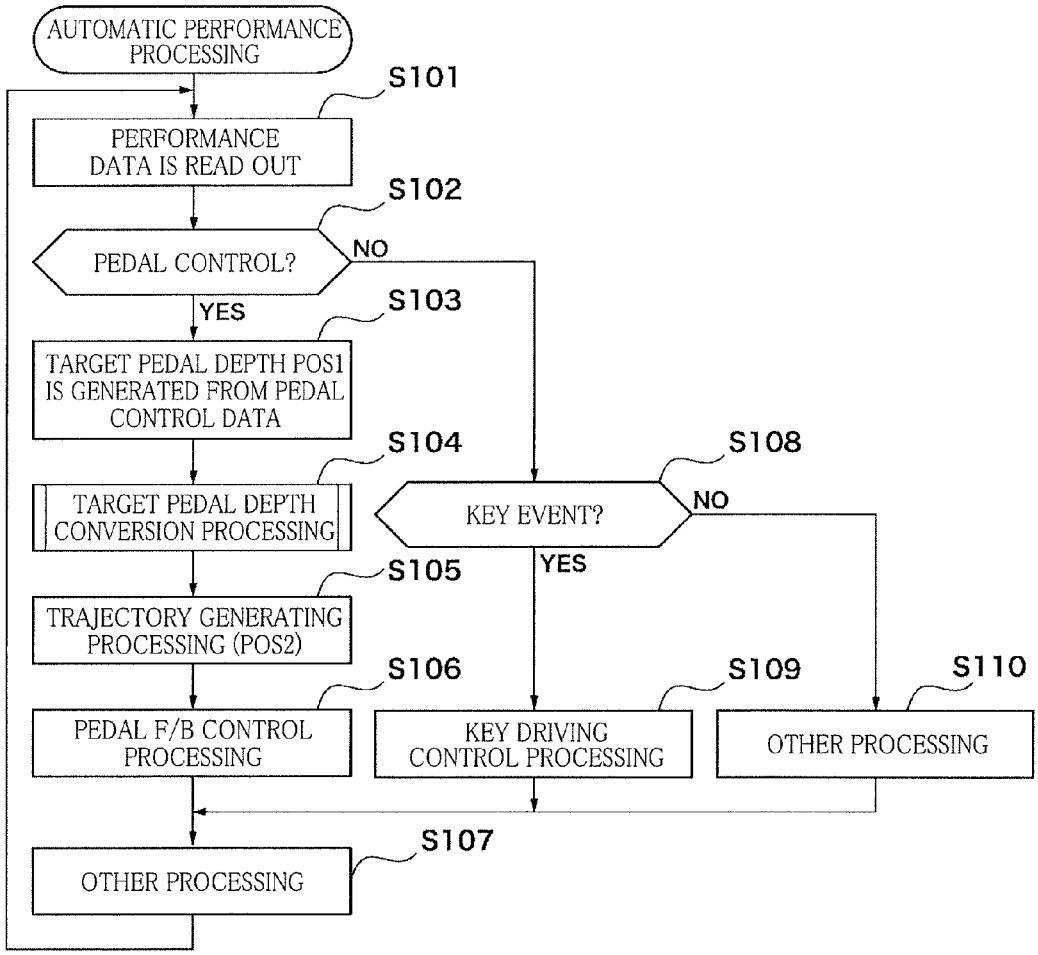
FIG. 6 is a flow chart of automatic performance processing.

FIG. 6 is a flow chart of automatic performance processing. In the automatic player piano 100, various modes such as an automatic performance mode and a manual performance mode are settable. The processing of FIG. 6 is executed by the CPU 102 when the automatic performance mode is set. In particular, steps S103-S106 and S109 are processing details of the motion controller 140.

Initially, the performance data is read out from the disk drive 120 (step S101). Next, it is judged whether or not the currently read event data of the performance data is related to the pedal control (the pedal control data) (step S102). If not, it is judged whether or not the event data of the performance data is related to the key control (key event: the tone generation control data) (step S108).

Where it is judged in step S102 that the event data of the performance data is related to the pedal control, there is generated data of the target pedal depth POS1 in accordance with the MIDI value of the pedal control data in the performance data (step S103), and target pedal depth conversion processing of FIG. 7 (which will be explained) is executed (step S104). The feature of the power save driving in the present embodiment resides in processing of FIG. 7 (step S104 of FIG. 6). It is noted, however, that the value of the target pedal depth POS1 may be maintained without being substantially changed by the processing of FIG. 7.

Next, trajectory generating processing is executed on the basis of the target pedal depth POS1 which has been converted in step S104 (step S105). In this trajectory generating processing, there is generated a directed depth value POS2 that is information as to the depth of the damper pedal 110 at which the damper pedal 110 should be located in accordance with a time. Subsequently, pedal feedback (F/B) control processing is executed for controlling the pedal solenoid 23 such that the damper pedal 110 moves according to the generated directed depth value POS2 (step S106).

In this pedal F/B control processing, a drive signal that permits the position of the damper pedal 110 to coincide with the directed depth value POS2 is generated, on the basis of a detected depth of the damper pedal 110 and a velocity of the damper pedal 110 calculated from the detected depth, and the generated drive signal is outputted to the PWM signal generating section 142*b*. The detected depth indicated above is a value of the detection signal by the pedal position sensor 24 supplied from the A/D converting section 141*b*. The PWM signal generating section 142*b* supplies a PWM signal in accordance with the drive signal to the pedal solenoid 23, so that the plunger displaces and the damper pedal 110 is thereby driven.

Where it is judged in step S108 that the read data is related to the key control, there is executed key driving control processing based on the tone generation control data in the performance data (step S109). This key driving control processing is known processing. In the key driving control processing, a trajectory is formed on the basis of target positions indicated by the tone generation control data, and a feedback control is executed using the detected position and velocity of the keys 1.

Where it is judged in step S108 that the read data is not related to the key control, other processing relating to the performance data is executed (step S110). After the processing in steps S106, S109, S110, processing other than the performance data, such as processing relating to a manual operation, is executed (step S107), and the automatic performance processing is ended.

Figure 7:
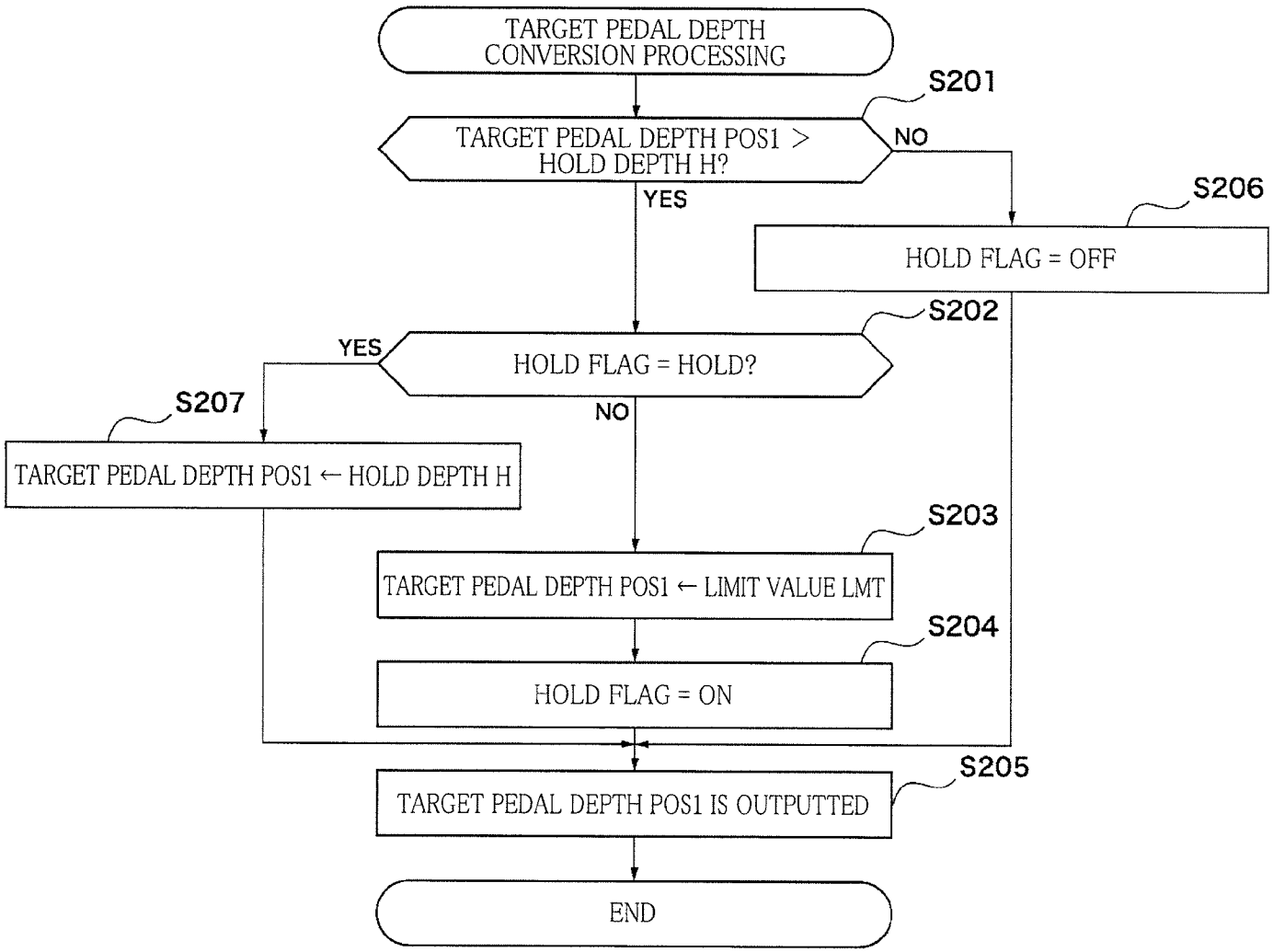
FIG. 7 is a flow chart of target pedal depth conversion processing executed in step S104 of FIG. 6.

FIG. 7 is a flow chart of the target pedal depth conversion processing executed in step S104 of FIG. 6. Initially, it is judged whether or not the target pedal depth POS1 has exceeded the hold depth H (step S201). Where the target pedal depth POS1 does not yet exceed the hold depth H, a HOLD flag is set at "OFF" (step S206), and step S205 is subsequently implemented.

Where it is judged in step S201 that the target pedal depth POS1 has exceeded the hold depth H, it is judged in step S202 whether or not the HOLD flag is set at "HOLD". The HOLD flag being set at "HOLD" means a state in which the target pedal depth POS1 is being converted into a value that is the same as the hold depth H.

Where it is judged in step S202 that the HOLD flag is not set at "HOLD", the limit value LMT is set as the target pedal depth POS1, in place of the current value (step S203), and the HOLD flag is set at "ON" (Step S204). Accordingly, after the target pedal depth POS1 has exceeded the hold depth H, the damper pedal 110 operates so as to move to the depression depth corresponding to the limit value LMT as a target. Thereafter, step S205 is implemented.

Figure 8:
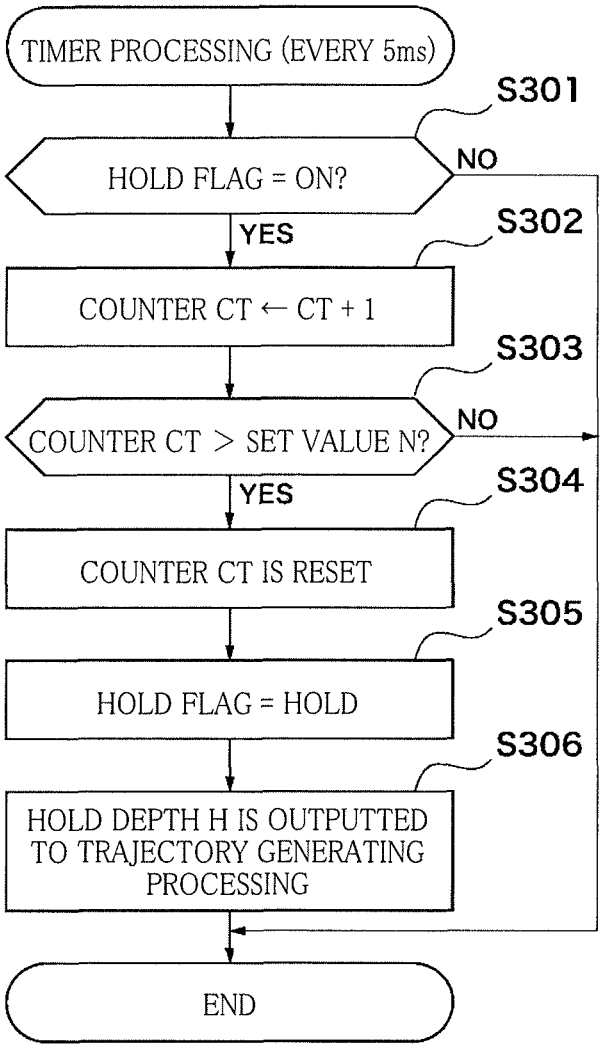
FIG. 8 is a flow chart of timer processing.

FIG. 8 is a flow chart of timer processing. The timer processing is repeatedly executed at certain time intervals (e.g., at intervals of 5 ms) during execution of the processing of FIG. 6. In the timer processing, when the HOLD flag becomes "ON", a counter CT is incremented (step S302), and steps S301-S303 are repeated until the counter CT becomes larger than a set value N (the counter CT>N), e.g., a value corresponding to a prescribed time (200 ms), in step S303. When the counter CT becomes larger than the set value N (the counter CT>N), the counter CT is reset at 0 (step S304), the HOLD flag is set at "HOLD" (the HOLD flag=HOLD) (step S305), and the hold depth H is outputted as the target pedal depth POS1 to the trajectory generating processing (step S306). Then the present processing is ended.

Accordingly, the HOLD flag becomes "HOLD" after the prescribed time has elapsed from a time point when the target pedal depth POS1 is set to the limit value LMT in step S203 of FIG. 7. Where it is judged in step S202 that the HOLD flag is set at "HOLD" (the HOLD flag=HOLD), the hold depth H is set as the target pedal depth POS1, in place of the current value (step S207). Accordingly, the damper pedal 110 operates so as to move to the depression depth corresponding to the hold depth H as a target, from the depression depth corresponding to the limit value LMT. Thereafter, step S205 is implemented.

The above-indicated prescribed time is set as a time from the time point when the target pedal depth POS1 is set to the limit value LMT in step S203 of FIG. 7 to a time point when the damper pedal 110 reaches the depression depth corresponding to the limit value LMT and starts to return to the depression depth corresponding to the hold depth H. In this respect, a timer configured to measure an actual time may be provided in place of the counter CT, so as to manage the prescribed time.

In step S205, a current target pedal depth POS1 is outputted. In each of steps S203, S207, the inputted target pedal depth POS1 is outputted after having been converted. However, when the processing is executed via step S206, the inputted target pedal depth POS1 is outputted as it is, without being converted.

According to the present embodiment, where the damper pedal 110 exceeds the hold depth H in the fully released region, the damper pedal 110 returns to the hold depth H after once having moved to the vicinity of the limit value LMT. Therefore, it is possible to achieve power saving effectively utilizing the hysteresis characteristic in the pedal driving, without giving, to reproduction tones, an influence that arises from the motion of the pedal. Further, while the damper pedal 110 is being controlled so as to be kept located at the hold depth H after having returned to the hold depth H, the damper pedal 110 is being controlled so as to be kept located at the hold depth H until the target pedal depth POS1 becomes shallower than the hold depth H. In other words, while the damper pedal 110 is being controlled so as to be kept located at the hold depth H after having returned to the hold depth H, the damper pedal 110 is being controlled so as to be kept located at the hold depth H only when the target pedal depth POS1 becomes equal to or deeper than the hold depth H. Accordingly, the damper pedal 110 is prevented from being unnecessarily moved following a fluctuation of the target pedal depth POS1 or the like, and can be stably located at a certain position, thereby ensuring a high degree of power saving effect.

The control of the power save driving described above does not involve any hardware change and can be easily attained by retrofitting to conventionally existing keyboard musical instruments. Further, the power saving enables downsizing of the pedal solenoid 23 and facilitates a heat dissipation design owing to suppression of a heat dissipation amount, for instance.

In the illustrated example of the power save driving, the motion of the damper pedal 110 is controlled by the value of the target pedal depth POS1. The power save driving may be modified. For instance, power save driving similar to that explained above may be executed on the basis of a value obtained by actually detecting the position of the damper pedal 110. In this instance, step S201 of FIG. 7 is modified so as to judge whether or not the detected depth of the damper pedal 110 has exceeded the hold depth H. Further, step S204 of FIG. 7 and steps S301, S302, S304 of FIG. 8 are eliminated, and step S303 is modified so as to judge whether or not the detected depth of the damper pedal 110 has exceeded the limit value LMT.

Alternatively, step S104 of FIG. 6 may be eliminated, and conversion processing corresponding to that of FIG. 7 may be executed prior to step S106, on the basis of the directed depth value POS2 generated in the trajectory generating processing (step S105), in place of the target pedal depth POS1.

In the illustrated embodiment, the present invention is embodied as the keyboard musical instrument. The invention is applicable to a performance data conversion program for rewriting contents of the performance data to achieve the power save driving and a performance data conversion device equipped with a computer in which the conversion program is executabley incorporated.

Where the performance data (the pedal control data) is converted by the above-described performance data conversion program, each target pedal depth POS1 that is outputted in step S205 of FIG. 7 is temporarily stored with respect to each target pedal depth POS3 before being converted by the conversion program, for instance. The temporarily stored target pedal depth POS1 is set as the pedal control data converted by the conversion program, when the readout of the performance data (POS3) has ended. Subsequently, the performance data is updated by replacing the pedal control data in the performance data with the above-indicated pedal control data after conversion. By using the thus updated performance data in which the pedal control data is replaced, the power save driving described above can be realized even if it is applied to the conventional keyboard musical instruments as it is, without executing any special control.

In addition, the invention may be otherwise embodied. In the illustrated embodiment, the hold depth H used in step S201 of FIG. 7 and the hold depth H used in step S207 of FIG. 7 are common. The hold depth H used in step S201 and the hold depth H used in step S207 may be mutually different values which are shallower than the limit value LMT within the fully released region. Where the hold depth H used in step S201 and the hold depth H used in step S207 are made different from each other, the hold depth H used in step S207 needs to be a depth existing in the fully released region while the hold depth H used in step S201 need not necessarily be a value existing in the fully released region. That is, the hold depth H (as one example of the first depth) used in step S201 may be a depression depth of the damper pedal 110 when the damper pedal 110 is in the half pedal region, namely, when the damper pedal 110 is in a state in which the dampers 6 are in contact with the strings 4 and when the depression depth is the deepest (i.e., just before the dampers 6 start to be spaced apart from the strings 4). In this instance, the hold depth H (as one example of the third depth) used in step S207 exists in the fully released region and is deeper than the hold depth H used in step S201. As in the illustrated embodiment, in this arrangement, the target pedal depth POS1 is set so as to exist in the fully released region after an affirmative decision "YES" has been made in S201, so that the power saving can be achieved without giving, to reproduction tones, an influence that arises from the motion of the pedal.

In the illustrated embodiment, the tone generation based on the tone generation control data executed in parallel with the driving of the damper pedal 110 is attained by striking the strings as a result of driving of the keys 1. The tone generation may be electronic tone generation using the electronic tone generating section 160. In this instance, the musical tone characteristic of the electronic tones is controlled in accordance with the position of the damper pedal 110.

As far as the power saving is concerned, it is not necessarily essential to control the damper pedal 110 within the fully released region, and the damper pedal 110 may be controlled in the mute region or in the half pedal region. Further, the pedal is not limited to the damper pedal 110 (loud pedal), and the invention is applicable to the sostenuto pedal 111 and the soft pedal 112. Moreover, the invention is widely applicable to electronic musical instruments having a pedal driving function, other than grand pianos and upright pianos. In addition, the invention may be applied not only to the pedal, but also to the motion of the keys of the keyboard. The invention is particularly effectively applicable to a drive control of a keyboard with complicated actions, such as acoustic pianos.

The function of the power save driving may be arranged so as to be enabled and disabled. More specifically, the function of the power save driving may be set by a user's selection or may be set depending upon the motion status of the damper pedal 110. For instance, the function of the power save driving may be enabled where the load of the damper pedal 110 becomes higher than a certain level.

The feedback control of the damper pedal 110 may not be a servo control. Where the load of the damper pedal 110 is a spring characteristic and a thrust characteristic of the pedal solenoid to be driven is flat with respect to the position of the damper pedal 110, for instance, a position control may be executed by outputting and directing a duty by which a thrust force can be specified.

In the illustrated embodiment, the performance data is inputted by being read out via the disk drive 120. Any format and route of input and acquisition are available. For instance, the performance data may be inputted by downloading using communication through network or the like or may be read out from a memory device incorporated in the musical instrument. The performance data is not limited to the MIDI format, but may be any data for automatic performance. Accordingly, any format is available for the performance data, as long as the data contains data that specifies the tone generation and data that specifies the pedal motion.

A storage medium which stores a control program represented by software to achieve the present invention may be read in the present musical instrument, for thereby offering similar advantages described above. In this instance, a program code per se read out from the storage medium achieves the novel function of the present invention, and the storage medium which stores the program code constitutes the present invention. The program code may be supplied via a transmission medium or the like. In this instance, the program code per se constitutes the present invention. As the storage medium in those instances, there may be used a ROM, a floppy disk, a hard disk, an optical disk, a magneto-optical disk, a CD-ROM, a CD-R, a DVD-ROM, a magnetic tape, a nonvolatile memory card or the like.

The present invention includes not only an instance in which the functions of the illustrated embodiment are achieved by execution of the read program code by a computer, but also an instance in which an operating system (OS) or the like running on a computer partly or entirely executes actual processing on the basis of directions of the program code, so as to achieve the functions of the illustrated embodiment by the processing. Further, the present invention includes an instance in which the program code read out from the storage medium is written to a memory of an expansion board inserted in the computer or a memory of an expansion unit connected to the computer and a CPU or the like partly or entirely executes actual processing on the basis of directions of the program code, so as to achieve the functions of the illustrated embodiment by the processing.

What is claimed is:

1. A keyboard musical instrument, comprising:

keys;

a pedal;

an input portion configured to input performance data including tone generation control data that specifies generation and halt of a musical tone and pedal control data that specifies a depression depth of the pedal;

a drive portion configured to drive the pedal; and a controller configured to control the drive portion on the basis of the pedal control data in the performance data inputted by the input portion, wherein the controller is configured to control the drive portion such that, where the depression depth of the pedal exceeds a first depth by controlling the drive portion, the pedal is located at a third depth that is shallower than a second depth after the pedal has reached the second depth that is deeper than the first depth.

2. The keyboard musical instrument according to claim 1, wherein the controller is configured to control the drive portion by determining a target position of the pedal on the basis of the pedal control data and to continue a control in which the target position of the pedal is set at the third depth until the target position becomes shallower than the third depth when the controller controls the drive portion such that the pedal is located at the third depth after the pedal has reached the second depth.

3. The keyboard musical instrument according to claim 1, wherein both of the first depth and the third depth are deeper than any depression depth of the pedal in a half pedal region.

4. The keyboard musical instrument according to claim 1, wherein the pedal is a damper pedal.

5. The keyboard musical instrument according to claim 4, further comprising: strings configured to be struck by depression of keys; dampers configured to be selectively placed in a contact state in which the dampers are in contact with the strings and a spaced state in which the dampers are spaced apart from the strings; and a damper mechanism configured to move the dampers from the contact state to the spaced state as the depression depth of the damper pedal becomes deeper, wherein the first depth is a depth that is the same as or deeper than the depression depth of the damper pedal in a state in which the dampers are in the contact state and the depression depth of the damper pedal is the deepest, and wherein the third depth is deeper than the first depth.

6. The keyboard musical instrument according to claim 4, further comprising: strings configured to be struck by depression of keys; dampers configured to be selectively placed in a contact state in which the dampers are in contact with the strings and a spaced state in which the dampers are spaced apart from the strings; and a damper mechanism configured to move the dampers from the contact state to the spaced state as the depression depth of the damper pedal becomes deeper, wherein each of the second depth and the third depth is the depression depth of the damper pedal in a state in which the dampers are in the spaced state.

7. A non-transitory storage medium in which is stored a program which permits a computer to execute a control of a keyboard musical instrument including a drive portion configured to drive a pedal, wherein the program comprises:

an input step of inputting performance data including tone generation control data that specifies generation and halt of a musical tone and pedal control data that specifies a depression depth of the pedal; and a control step of controlling the drive portion on the basis of the pedal control data in the performance data inputted in the input step, wherein the control step controls the drive portion such that, where the depression depth of the pedal exceeds a first depth by controlling the drive portion, the pedal is located at a third depth that is shallower than a second depth after the pedal has reached the second depth that is deeper than the first depth.

8. A non-transitory storage medium in which is stored performance data conversion program executed by a computer, wherein the performance data conversion program comprises:

an input step of inputting performance data including tone generation control data that specifies generation and halt of a musical tone and pedal control data that specifies a depression depth of a pedal;

a conversion step of converting the pedal control data in the performance data inputted in the input step; and an update step of updating the performance data by replacing the pedal control data in the performance data inputted in the input step with the pedal control data that has been converted in the conversion step, wherein the conversion step converts the pedal control data such that, where the depression depth of the pedal indicated by the pedal control data exceeds a first depth, the pedal is located at a third depth that is shallower than a second depth after the pedal has reached the second depth that is deeper than the first depth.

9. A performance data conversion device equipped with a computer in which the performance data conversion program stored in the non-transitory storage medium defined in claim 8 is executably incorporated.

* * * * *